United States Patent [19]

Koch

[11] 3,983,524

[45] Sept. 28, 1976

[54] ELECTRICAL CURRENT LIMITING FUSE HAVING FUSIBLE ELEMENT WITH ADDITIONAL CROSS-SECTIONAL NECKS AT AN ARCING CLIP

[75] Inventor: Robert E. Koch, Pittsfield, Mass.

[73] Assignee: General Electric Company, N.Y.

[22] Filed: Oct. 9, 1975

[21] Appl. No.: 621,080

[52] U.S. Cl. ..... 337/159; 337/162; 337/229

[51] Int. Cl.[2] ..... H01H 85/04

[58] Field of Search ..... 335/158, 159, 161, 162, 335/164, 229, 276, 278, 293, 297

[56] References Cited

UNITED STATES PATENTS 3,755,769 8/1973 Mikulecky ..... 337/158

3,876,966 4/1975 Fister ..... 337/158

*Primary Examiner*—George Harris

*Attorney, Agent, or Firm*—Volker R. Ulbrich

[57] ABSTRACT

The fuse is of the general purpose type having a casing closed at the ends by terminal caps; a core inside the casing; a main fusible element wound about the core and connected between the caps; a pair of arcing clips mounted in spaced relation on the core adjacent the main fusible element; and, an auxiliary element also wound about the core and connecting together the arcing clips. The improvement comprises that segments of the main element passing over the arcing clips are provided with additional reduced cross-sectional necks for improving the melting response of the element upon arcing between the element and the clips.

6 Claims, 2 Drawing Figures

ELECTRICAL CURRENT LIMITING FUSE HAVING FUSIBLE ELEMENT WITH ADDITIONAL CROSS-SECTIONAL NECKS AT AN ARCING CLIP

BACKGROUND OF THE INVENTION

The present invention relates generally to high voltage current limiting electrical fuses and particularly to such fuses of the general purpose type which can effectively interrupt both low and high currents.

High voltage fuses generally have an insulating tubular casing closed at both ends by metal terminal caps. An insulating fuse core typically extends between the caps inside the casing. Wound helically on the fuse core is a main fusible element, which may be one wire or ribbon, or several in parallel, connected at the ends to the terminal caps. The space in the casing around the main element is filled with a tightly packed arc-quenching filler, such as quartz sand.

The main fusible element is typically a silver ribbon which is perforated at regular intervals to provide cross-sectional "necks" which will melt prior to melting of the ribbon proper when the fuse carries a high fault current. Thus a high fault current results in the generation of a number of regularly spaced arcs which interact with the filler to limit the fuse current in a controlled fashion as the main element is consumed by arcing, until eventually all current ceases. The cross-sectional necks in the ribbon are an important feature for preventing the establishment of only a single arc, or merely several which might consume the ribbon entirely to the terminal cap and damage the cap to result in a failure mode for the fuse. The necks sufficiently increase the ribbon resistance locally that each neck is certain to generate an arc at high fault currents.

Low fault current operation of such a fuse is a somewhat different matter. At low currents, the distribution of melting $I^2t$, the product of the square of the current and time, in the main element is not sufficiently determined by the necks to assure that arcs will be generated at all their locations. The thermal conductivity of the filler and the thermal gradients in the fuse as a whole now play a major role in determining which neck will be first to melt. If the first to melt is near a terminal cap, the main element may be consumed adjacent to the cap, and this may result in a failure. Therefore, it is common practice to place near the center of the ribbon length an overlay of a lower melting point solder. Prior to any melting of the ribbon, the solder melts and reacts with the ribbon chemically to increase its resistance, thereby assuring the initiation of arcing at that central point.

It is desirable for the clearing characteristics of the fuse to establish additional arcs after the initial melting of the central ribbon segment. For this purpose it is known to provide two metal arcing clips mounted on the core, each to one side of the center of the fuse, and half the distance to the cap and spaced a predetermined critical gap from the main ribbon element. The clips are connected together electrically by an auxiliary wire element also wound about the core. As the initial central segment arc becomes elongated, and thus has an increasing potential difference between its ends, the ribbon portions opposite the clips also have this potential difference, and thus a voltage half that value appears across each of the gaps. The gap voltage increases until the dielectric material or air in the gap breaks down and arcing results to melt the ribbon opposite the clips. The arcing is then maintained between the severed ribbon ends by the fuse current until the fuse clears. Control of the gap spacing, the number of clips, and the spacing of the clips along the length of the ribbon thus affords control of the arc generation at lower fault currents.

One problem with fuses of the above type has been that of obtaining a uniform melting characteristic of the segment of main element opposite the arcing gaps. If a cross-sectional neck should happen to be located opposite the clip, then arcing of the gap will melt the main element in less time than if no such neck appears opposite the clip. Moreover, it would require substantial additional efforts to adjust the components of each fuse so that one of the regular necks would appear opposite each of the clips.

SUMMARY OF THE INVENTION

In the novel fuse, the segments of main fusible element opposite the arcing clips are provided with cross-sectional necks which are in addition to the regularly spaced necks of the element. The additional necks provide a more uniform melting characteristic for the segments upon arcing, without requiring costly additional procedures in the manufacture of the fuse.

DESCRIPTION OF THE PREFERRED EMBODIMENT

Figure 1:
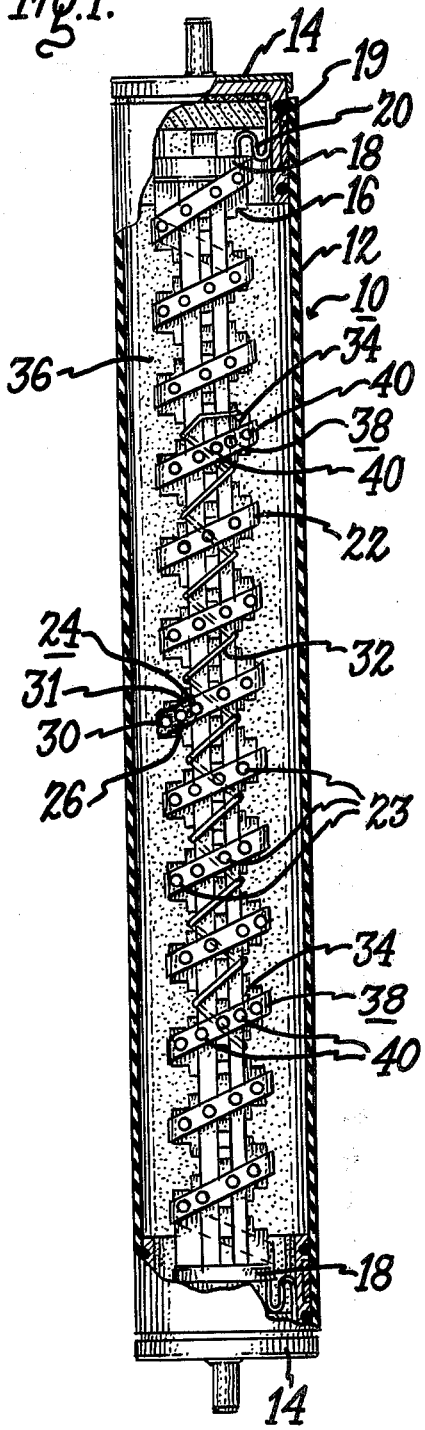
FIG. 1 is a partially exposed, partially sectioned side view of a current limiting fuse in accordance with a preferred embodiment of the present invention.

A preferred embodiment of the invention is the general purpose fuse 10 shown in FIG. 1 of the drawing. The fuse 10 has an insulating tubular casing 12 of glass fibers and epoxy with an inside diameter of about 5cm (centimeters) and sealed at both ends by bronze terminal caps 14. Situated between the caps 14 and extending along the interior of the fuse 10 is a stepped, gas-producing support core 16 which is centered in the caps 14 by metal connector clips 18 having tabs 20 welded to the inside wall of a sleeve 19. A pure silver fusible ribbon element 22 is wound helically on the outermost steps of the core 16 along the axis of the fuse 10 and connected at its ends to the connector clips 18. The ribbon element 22 is about 0.0125cm thick, about 0.47cm wide and provided at 1.27cm intervals with round, regular perforations 23 about 0.32cm in diameter for cross-section necks. A central segment 24 of the ribbon 22 has two additional perforations 26, one of which is hidden from view, located midway between a central perforation 30 and the regular perforations 23 to either side for surface area necks. The surface on the outer side of the ribbon 22 between approximately the midpoints of the additional perforations 26 is covered with a solder overlay 31 of about 60% lead and 40% tin, by weight.

Figure 2:
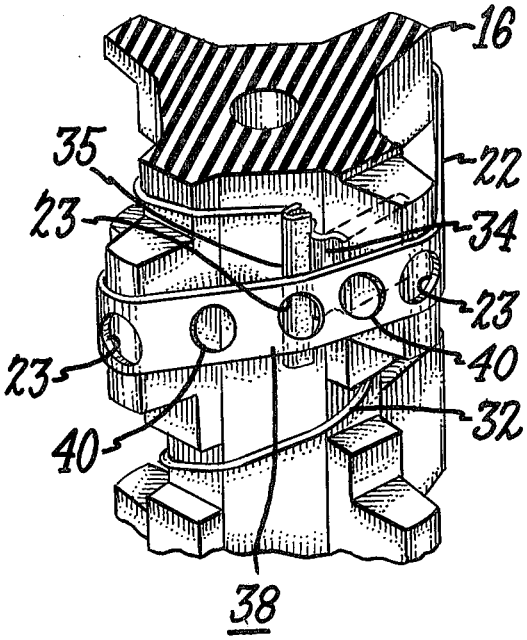
FIG. 2 is an exaggerated elevational view of a fragment of the fuse of FIG. 1, showing an arcing clip and its associated structures in greater detail.

An auxiliary fusible silver wire element 32 about 0.025cm in diameter is wound helically about the innermost steps of the core 16 between two metal arcing clips 34, one of which is shown in more detail in FIG. 2, which press outwardly on a portion of the ribbon 22. The clips 34 are each located about midway between the central segment 24 of the ribbon 22 and one connector clip 18. Covering the surface of each arcing clip 34 and interposed between it and the ribbon, is a piece of non-porous aromatic polyamide resin paper dielectric tape 35 about 0.05 millimeters thick, and having a dielectric strength of about 900 volts per mil (per 25.4 micrometers). Arcing segments 38 of the ribbon 22 opposite the clips 34 have additional perforations 40 so that the location of the clip 34 along the ribbon 22 is relatively non-critical.

The remaining interior space of the fuse 10 around the ribbon 22, the wire 32 and the core 16 is filled with a tightly packed arc-quenching quartz sand filler 36 which is bound into a rigid matrix by colloidal silica particles.

When the fuse 10 passes a low fault current, as the temperature of the ribbon 22 increases to near the fusion point of the solder overlay 31, the solder overlay 31 begins to melt and to diffuse into the ribbon 22 to form an alloy having a greater resistance than the ribbon element 22. This causes the segment 24 to rapidly melt and initiate arcing. As the ribbon 22 burns back and the voltage across the arc is increased by the increased arc length, the voltage of the arc appears across the tape 35 of the arcing clips 34 which are maintained at the same potential by the wire element 32. When the voltage across the tape 35 reaches a critical value, the tape 35 breaks down and arcing between the clips 34 and the ribbon 22 melts the segments 38 of the ribbon 22 at the clips 34 to also establish arcs there to more rapidly limit the current.

The number of additional necks provided in the main element opposite the clips is relatively non-critical, but no more should be provided than necessary for ease of fabrication of the fuse. Generally, for the case of a perforated ribbon element, two or three additional perforations for each segment are sufficient, each additional perforation being spaced midway between two regularly spaced perforations of the element. The additional perforations have been found to have little effect on the current-carrying capacity of the element or its high current melting characteristics.

It should be understood that while in the fuse of the preferred embodiment the main fusible element is a ribbon with perforations, the present invention is also applicable to other types of elements with reduced cross-sections. For instance, a wire element may have necks of reduced diameter. A ribbon may also have necks formed by providing notches in one or both sides of the ribbon.

I claim:

1. A current-limiting fuse of the type having a tubular insulating casing;

first and second conductive terminal members closing the first and second ends, respectively, of said casing;

an insulating core extending longitudinally inside said casing between said terminal members;

a main fusible element wound helically on said core and connected at its ends to said terminal members;

at least a first conductive arcing clip mounted on said core adjacent a segment of said main fusible element; and, an auxiliary conductive element wound around said core and having one end connected to said arcing clip, wherein the improvement comprises that:

said segment of said main fusible element is provided with cross-sectional necks which are in addition to any regularly spaced necks provided along the length of the element for high-current melting characteristics.

2. The fuse defined in claim 1 and wherein said main element is a ribbon.

3. The fuse defined in claim 2 and wherein said ribbon has regularly spaced perforations along its length which are provided for high-current melting characteristics.

4. The fuse defined in claim 1 wherein said additional necks are additional perforations in said segment.

5. The fuse defined in claim 4 and wherein said additional perforations are the same size as are said regularly spaced high-current characteristic perforations and are each located midway between two of said regularly spaced perforations.

6. The fuse defined in claim 4 and comprising about three additional perforations in each segment.

* * * * *